US007472534B2

(12) United States Patent
Mustalahti et al.

(10) Patent No.: US 7,472,534 B2
(45) Date of Patent: Jan. 6, 2009

(54) METHOD FOR ENSURING AND MEASURING THE INTERNAL TENSION OF AN ELEVATOR HOISTING ROPE, AND ELEVATOR PERMITTING THE USE OF SAID METHOD

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 462 days.

(21) Appl. No.: 11/121,980

(22) Filed: May 5, 2005

(65) Prior Publication Data

US 2005/0211507 A1 Sep. 29, 2005

Related U.S. Application Data

(63) Continuation of application No. PCT/FI03/00756, filed on Oct. 13, 2003.

(30) Foreign Application Priority Data

Nov. 15, 2002 (FI) ..... 20022040

(51) Int. Cl.
*D01H 13/00* (2006.01)

(52) U.S. Cl. ..... 57/1 R

(58) Field of Classification Search ..... 57/1 R, 57/2.3; 187/391, 414
See application file for complete search history.

(56) References Cited

U.S. PATENT DOCUMENTS 1,861,908 A 6/1932 Culp
5,731,528 A 3/1998 Yamazaki et al.

FOREIGN PATENT DOCUMENTS

SU 1 562 278 A 5/1990

OTHER PUBLICATIONS

International Search Report & International Preliminary Examination Report.

*Primary Examiner*—Shaun R Hurley
(74) *Attorney, Agent, or Firm*—Harness, Dickey & Pierce, P.L.C.

(57) ABSTRACT

A method for ensuring tightness of two or more hoisting ropes in an elevator may include: installing the two or more hoisting ropes in the elevator; running the elevator to verify proper operation of the elevator; and tightening the two or more hoisting ropes after running the elevator to verify proper operation. An elevator may include two or more hoisting ropes. The tightness of the two or more hoisting ropes may be ensured by the method discussed above.

19 Claims, 3 Drawing Sheets

METHOD FOR ENSURING AND MEASURING THE INTERNAL TENSION OF AN ELEVATOR HOISTING ROPE, AND ELEVATOR PERMITTING THE USE OF SAID METHOD

PRIORITY STATEMENT

This application is a continuation of, and claims priority under 35 U.S.C. §120 and 35 U.S.C. §365(c) from, PCT International Application No. PCT/FI2003/000756 which has an International filing date of Oct. 13, 2003, which designated the United States of America, and FINLAND Application Priority No. 20022040 filed Nov. 15, 2002 the entire contents of all of which are hereby incorporated herein by reference.

BACKGROUND

1. Field

The present invention relates to a method for ensuring the internal tightness of elevator hoisting ropes and to elevators permitting the use of the method.

2. Description of Related Art

In the use of hoisting ropes, and especially thin elevator hoisting ropes provided with a steel core, it is important to make sure that the mutual tightness of the strands of the hoisting rope is correct after installation and remains as correct as possible during operation of the elevator. The internal tension of the rope may change during installation of the elevator in connection with the handling of the rope. Any loosening between the strands that has started at installation time may accumulate in a given portion of the rope in the longitudinal direction of the rope during operation of the elevator. Such a portion may be e.g. the stretch between the traction sheave and the suspension point in the ceiling if the originally loosened part was in this rope portion. When the rope is twisted in the loosening direction relative to its braid structure, the braiding of the strands forming the rope sheath is opened and the braid structure holding the rope in shape becomes loose, with the result that the interlock between strands is loosened and the contact of the strands with each other is diminished. In consequence, the length of the rope sheath, i.e. the outermost layer of the rope, is increased along the length of the rope, and so the load of the rope is shifted to the straight core strand. Such internal loosening of the rope is a definite risk factor, which may cause serious damage to the hoisting rope.

SUMMARY

The object of the present invention is to overcome the above-mentioned drawbacks and to provide a dependable, reliable, easy-to-implement and fast method for ensuring and measuring a sufficient tightness of an elevator hoisting rope, and thus to reduce the risk the hoisting ropes being damaged in connection with elevator operation, thereby also improving the operational dependability, reliability and safety of the elevator.

A further object of the invention is to achieve an elevator with re-tightened hoisting ropes.

The method of the invention for ensuring and measuring the internal tightness of elevator hoisting ropes, elevators permitting the use of the method, and other embodiments of the invention are described below.

By applying the invention, one or more of the following advantages, among others, can be achieved:

- reliability of the hoisting rope is improved because a desired internal tightness can be achieved and maintained
- operational dependability and reliability of the elevator is improved because damage due to internal loosening of the rope is avoided
- a sufficient internal tightness keeps the rope sheath well in shape, allowing a good and uniform friction to be achieved between the rope and the rope groove over the entire length of the rope
- the invention makes it possible to reduce elevator installation times and the total installation costs because the tightening method and the measurement of tightness are fast and easy to carry out.

A primary area of application of the invention is elevators designed for freight/passenger transportation. Another primary area of application is in elevators having relatively thin twisted hoisting ropes provided with a steel core.

BRIEF DESCRIPTION OF THE DRAWINGS

In the following, the invention will be described in detail by means of an example with reference to the attached drawings, wherein.

DETAILED DESCRIPTION OF EXAMPLE EMBODIMENTS

Figure 1:
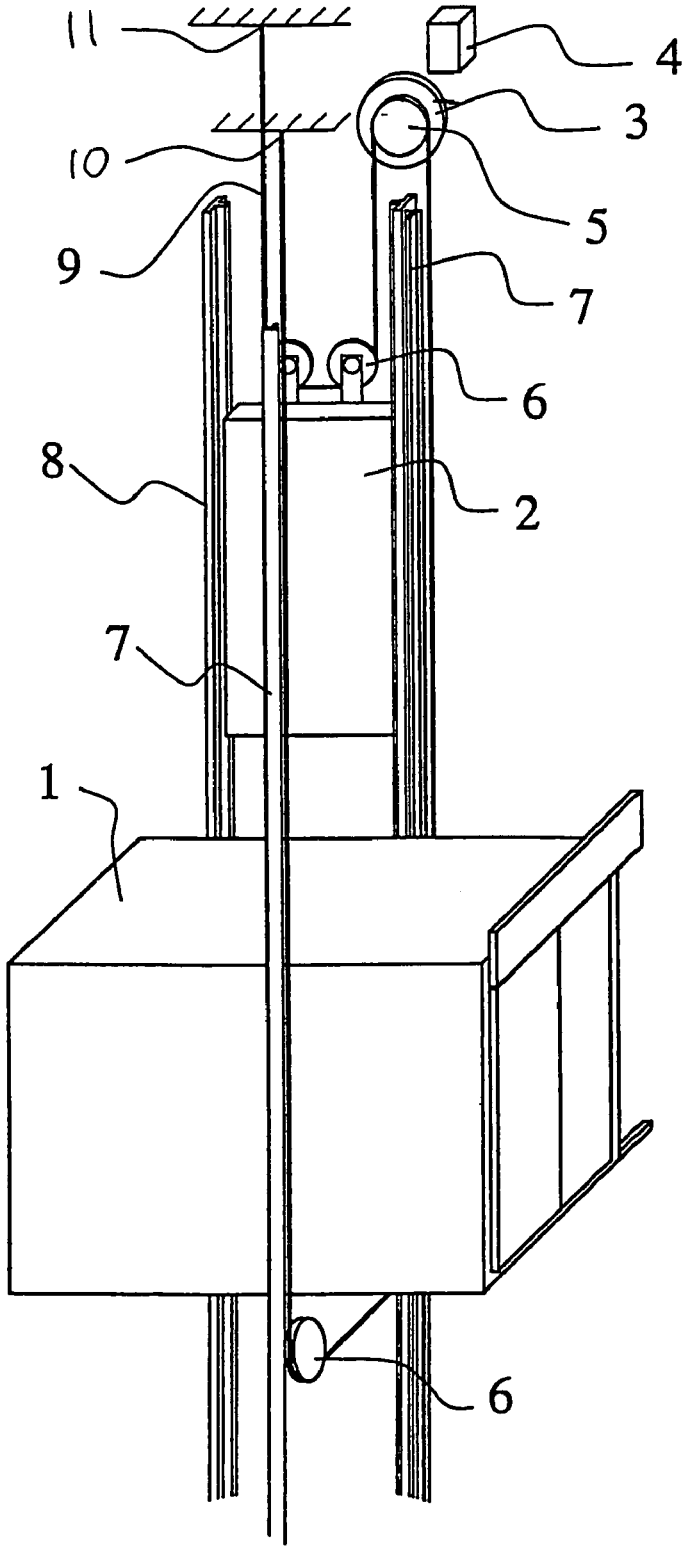
FIG. 1 presents a simplified and oblique top view of an elevator solution applying the invention.

FIG. 1 presents a typical elevator solution in which the method of the invention for ensuring and measuring the internal tightness of an elevator hoisting rope can be used. The elevator is preferably an elevator without machine room and having a hoisting machine 3 connected via a traction sheave 5 to a set of hoisting ropes, which consists of hoisting ropes 9 running parallel to each other and supporting a counterweight 2 and an elevator car 1 moving on their respective tracks, i.e. along guide rails 8 and 7. The parallel hoisting ropes 9 are anchored to a fixed starting point 10, from which the ropes go downwards towards a diverting pulley 6 mounted in conjunction with the elevator car 1, at a position substantially below the elevator car. From the diverting pulley 6, the hoisting ropes go to a second corresponding diverting pulley placed at the other lower edge of the elevator car and, having passed around this second diverting pulley, they go upwards to the traction sheave 5 of the elevator machine 3 disposed in the in the upper part of the elevator shaft. Having passed around the traction sheave 5 by its top side, the hoisting ropes go again down to diverting pulleys 6 mounted in conjunction with the counterweight 2, passing around these pulleys by their lower side and then returning again up to their fixed end point 11. The functions of the elevator are controlled by a control system 4.

Figure 2:
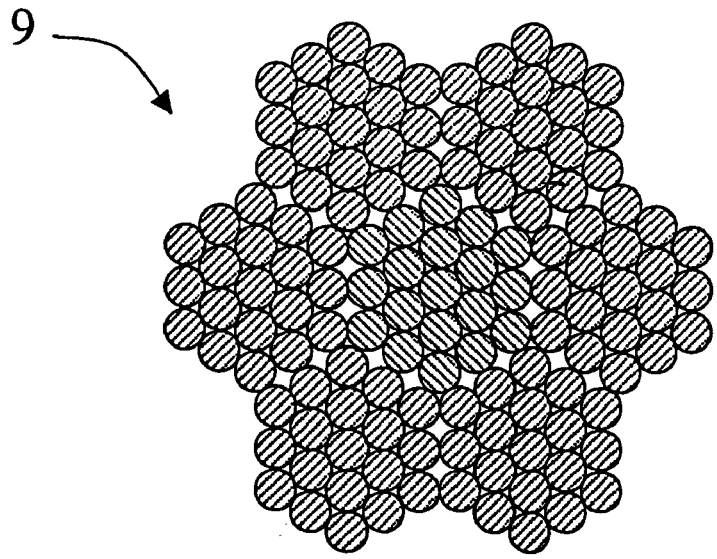
FIG. 2 presents a cross-sectional view of a hoisting rope applicable in the solution of the invention.
Figure 3:
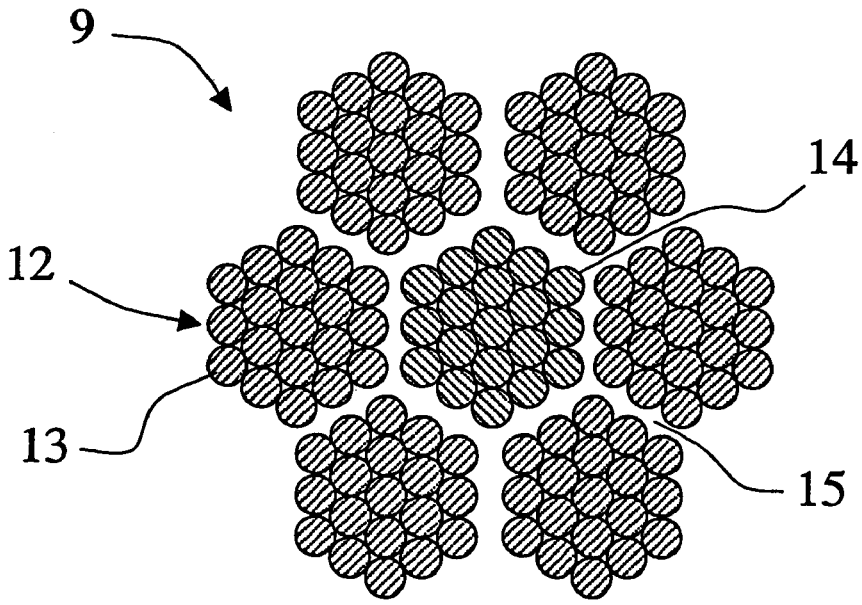
FIG. 3 presents a cross-sectional view of the hoisting rope in FIG. 2 in a situation where the rope has been partly untwisted.

FIGS. 2 and 3 present cross-sectional views of a hoisting rope applicable in the solution of the invention. In the situation represented by FIG. 2, the hoisting rope 9 is in a correct state of tightness, with all its strands tightly twisted according to their braiding around the core strand. FIG. 3 again illustrates a situation where the braiding of the rope has become loose. The figure shows the rope with an exaggerated loosening to provide a sufficient visual impression. As a result of the loosening, the six strands 12 forming the sheath of the rope 9, each of which in this case consists of nineteen wires 13 twisted around each other, have come loose of the core strand 14 forming the core of the rope. As a result of the loosening, there appears both between the strands 12 of the rope sheath and between the sheath strands 12 and core strand 14 a clearance 15, the magnitude of which is not necessarily the same in all parts of the rope. Because of the clearance 15, the contact of the rope strands with each other is diminished, and the effect locking the braiding together is also weakened.

Figure 4:
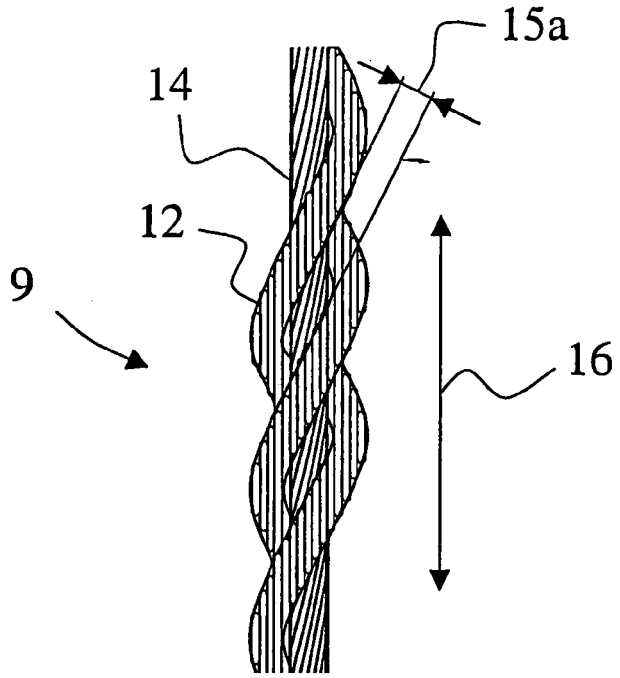
FIG. 4 presents the hoisting rope in a simplified side view in a situation where the rope has been partly untwisted.

FIG. 4 presents a hoisting rope 9 thus loosened, in side view and simplified for visual clarity. The core strand 14 is straight, but a loosened strand 12 has grown in length in the longitudinal direction 16 of the hoisting rope 9 because, due to a diminished contact and interlock between strands 12, there has also appeared between the twists of the strand 12 a clearance 15*a*, which has an effect in the longitudinal direction 16 of the hoisting rope 9. The more the braiding of the strand 12 becomes untwisted, the more will the virtual length of the strand 12 increase in the longitudinal direction of the hoisting rope 9. The length is, of course, at a maximum when the braiding has been straightened completely.

The method of the invention ensures a structural tightness and tension of the hoisting ropes 9 sufficient to keep the hoisting rope 9 together, to ensure that after start-up of the elevator there will appear no accumulated looseness that would make the hoisting rope 9 susceptible to damage. Sufficient tightness of the hoisting rope 9 is ensured at installation time. At the end of the installation operation, when the installation has been finished in other respects, the mutual tightness of all the parallel hoisting ropes 9 is first ensured by equalizing the spring lengths, if necessary, and performing a sufficient number of equalizing runs, if necessary. After the aforesaid operations have been carried out, the second ends of the hoisting rope 9 are released from their anchorage and all the hoisting ropes 9 are tightened by twisting them from the free end and over a free straight portion as long as possible in the same direction with the pitch of the rope helix by a number of turns required to achieve a sufficient tightness. This tightening action is continued until the tightening effect is propagated after the straight portion even over the diverting pulleys 6 and other pulleys. The required number of turns depends at least on the length of the hoisting rope 9. For example, in the case of a 7-strand, 4 mm hoisting rope 9 with a pitch of 25 mm, to obtain a sufficient tightness, the hoisting rope 9 is twisted by greater than about 0.2 and less than about 2 turns/meter of hoisting length, preferably greater than about 0.5 and less than about 1.5 turns/meter of hoisting length, and most preferably greater than about 0.9 and less than about 1.1 turns/meter of hoisting length. More generally, in the case of a 4 mm rope having a hoisting length of 4 m (and a pitch of 25 mm) and thus 160 pitches (4000/25=160), this means that a preferable number of turns is greater than about 1 turn per 320 twist pitches and less than about 1 turn per 100 twist pitches (e.g., 1 turn/320 twist pitches produces a looser rope, while 1 turn/100 twist pitches produces a tighter rope). A suitable tightness is greater than about 1 turn/180 twist pitches and less than about 1 turn per 150 twist pitches. In most hoisting ropes 9, a sufficient tightness can be achieved by using values greater than 1 turn/400 twist pitches and less than 1 turn/100 twist pitches. In the discussion above, twist pitch refers to the number of rope twists, i.e., twist pitches over the entire hoisting length of the hoisting rope 9. As a final result, a hoisting rope 9 is achieved in which the outer strands 12 forming the rope sheath have a greater tension than the core strand 14 inside the hoisting rope 9. In another embodiment of the invention, it is also possible to use ropes thinner than 4 mm, e.g., hoisting ropes 9 with a diameter of about 3 mm or even less. In the case of thinner ropes, it is possible to use ropes 9 having a number of twists larger than the numbers mentioned above.

Figure 5:
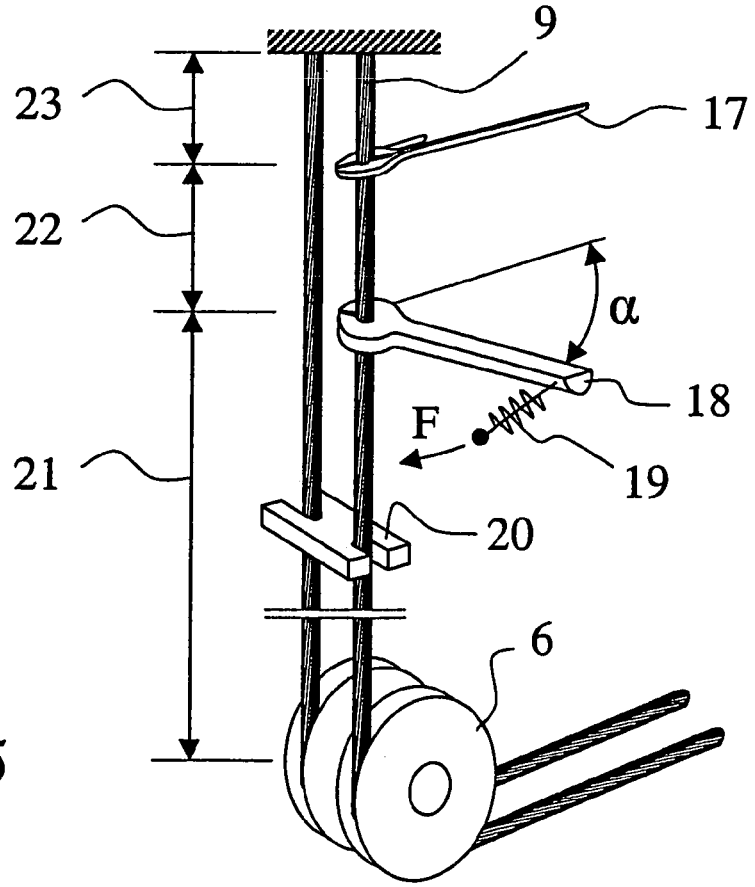
FIG. 5 illustrates an oblique side view of a situation where the tightness of the hoisting rope is being measured.

In practice, the required number of tightening turns need not necessarily be calculated in the manner described above. A sufficient tightness can be easily measured by a suitable measuring procedure. FIG. 5 visualizes a measuring method according to the invention that is suited to this purpose and guarantees a sufficient tightness. FIG. 5 is depicted in a simplified form and is not drawn to scale. By the measuring method of the invention, the torque produced by the tightening tension of the hoisting rope 9 is measured. The measurement is carried out after the hoisting ropes 9 have been first tightened after installation to a substantially equal tightness and after a few equalizing runs have been performed to allow the tension differences between different parts of the hoisting rope 9 to be equalized. The measurement can be made from different points in the longitudinal direction of the hoisting ropes 9. Based on the measurement results, the hoisting rope 9 is tightened further if necessary to achieve a sufficient tightness.

For the measurement, a constant distance 21 must be allowed for the hoisting rope 9 as a straight free length of the hoisting rope 9. This distance is suitably, e.g., 3 m. In FIG. 5, we can assume that the distance 21 from the torsion moment measuring clamp 18 to the diverting pulley 6 is at least the required free length 3 m. Correspondingly, the measuring length 22 chosen to be used here is 0.5 m or 500 mm. The measuring length 22 is the distance from the torsion moment measuring clamp 18 to a holding clamp 17, by means of which the hoisting rope 9 is locked so that it cannot be twisted in the portion 23 above the holding clamp 17. In addition, a rope separator 20 must be placed between the hoisting rope 9 to be measured and the adjacent hoisting ropes 9 to provide a measuring space of required size. Parallel thin ropes lie very close to each other, in which case the horizontal distance between the hoisting ropes 9 has to be increased to permit the jaws of the torsion moment measuring clamp 18 to be placed around the hoisting rope 9 to be measured.

The measurement is carried out by holding the hoisting rope 9 in place by means of the holding clamp 17 and turning the torsion moment measuring clamp 18 provided with scales 19 through a constant twist angle $\alpha$ in the direction of the rope helix, i.e., in the twisting direction of the braiding. After this turning movement, the scales 19 of the torsion moment measuring clamp 18 will show the force F used to turn the clamp, this force being always the same for identical ropes at the same level of tightness. In FIG. 5, the structure of the scales 19 is depicted in a diagrammatic form.

The embodiments of the invention are not necessarily restricted to any embodiment described above but different embodiments can be combined partly or completely within the framework of technical requirements. Likewise, parts of different embodiments can be used to form embodiments according to the basic idea of the invention which are not presented here.

It is obvious to the person skilled in the art that the invention is not limited to the examples described above, but that it may be varied within the scope of the claims presented below. Thus, the size and structure of the elevator hoisting ropes used as well as the required number of tightening turns may differ from those mentioned above. Likewise, the measurement of a sufficient torsion moment can be carried out using instruments and values differing from those described above.

The invention claimed is:

1. A method for ensuring tightness of two or more hoisting ropes in an elevator, comprising:

installing the two or more hoisting ropes in the elevator;

running the elevator to verify proper operation of the elevator;

tightening the two or more hoisting ropes after running the elevator to verify proper operation; and measuring the tightness of the two or more hoisting ropes;

wherein measuring the tightness of the two or more hoisting ropes comprises:

locking a torsion device onto a first hoisting rope at a point of measurement;

turning the torsion device in a braiding twist direction of the first hoisting rope through a constant twist angle;

measuring a moment needed for turning the torsion device using a measuring device; and repeating the locking, turning, and measuring for a remaining hoisting rope or ropes.

2. The method of claim 1, further comprising:

completing installation of the elevator;

wherein running the elevator to verify proper operation is conducted after completing installation of the elevator.

3. The method of claim 1, further comprising:

running the elevator to equalize tensions within the two or more hoisting ropes, after tightening the two or more hoisting ropes; and re-tightening the two or more hoisting ropes after running the elevator to equalize tensions.

4. The method of claim 3, further comprising:

completing installation of the elevator;

wherein running the elevator to equalize tensions is conducted after completing installation of the elevator.

5. The method of claim 1, wherein the two or more hoisting ropes are tightened one at a time.

6. The method of claim 3, wherein the two or more hoisting ropes are re-tightened one at a time.

7. The method of claim 1, wherein tightening the two or more hoisting ropes comprises:

releasing a first end of the first hoisting rope from an attachment;

twisting the first hoisting rope in the braiding twist direction of the first hoisting rope;

reattaching the first end of the first hoisting rope to the attachment; and repeating the releasing, twisting, and reattaching for the remaining hoisting rope or ropes.

8. The method of claim 3, wherein re-tightening the two or more hoisting ropes comprises:

releasing a first end of the first hoisting rope from an attachment;

twisting the first hoisting rope in the braiding twist direction of the first hoisting rope;

reattaching the first end of the first hoisting rope to the attachment; and repeating the releasing, twisting, and reattaching for the remaining hoisting rope or ropes.

9. The method of claim 1, wherein after tightening the two or more hoisting ropes, a tension in sheath strands of a respective hoisting rope is greater than a tension in a core strand of the respective hoisting rope.

10. The method of claim 3, wherein after re-tightening the two or more hoisting ropes, a tension in sheath strands of a respective hoisting rope is greater than a tension in a core strand of the respective hoisting rope.

11. The method of claim 1, wherein tightening the two or more hoisting ropes comprises:

twisting the two or more hoisting ropes in the braiding twist direction of the two or more hoisting ropes;

wherein the two or more hoisting ropes are twisted greater than about 1 turn per 400 twist pitches and less than about 1 turn per 100 twist pitches.

12. The method of claim 1, wherein tightening the two or more hoisting ropes comprises:

twisting the two or more hoisting ropes in the braiding twist direction of the two or more hoisting ropes;

wherein the two or more hoisting ropes are twisted greater than about 1 turn per 180 twist pitches and less than about 1 turn per 150 twist pitches.

13. The method of claim 1, wherein tightening the two or more hoisting ropes comprises:

twisting the two or more hoisting ropes in the braiding twist direction of the two or more hoisting ropes;

wherein the two or more hoisting ropes are twisted greater than about 0.2 turns/meter of hoisting length and less than about 2 turns/meter of hoisting length.

14. The method of claim 1, wherein tightening the two or more hoisting ropes comprises:

twisting the two or more hoisting ropes in the braiding twist direction of the two or more hoisting ropes;

wherein the two or more hoisting ropes are twisted greater than about 0.5 turns/meter of hoisting length and less than about 1.5 turns/meter of hoisting length.

15. The method of claim 1, wherein tightening the two or more hoisting ropes comprises:

twisting the two or more hoisting ropes in the braiding twist direction of the two or more hoisting ropes;

wherein the two or more hoisting ropes are twisted greater than about 0.9 turns/meter of hoisting length and less than about 1.1 turns/meter of hoisting length.

16. The method of claim 1, wherein tightening the two or more hoisting ropes comprises:

releasing a first end of the first hoisting rope from an attachment;

providing a straight portion of the first hoisting rope starting from the first end;

twisting the first hoisting rope from the first end in the braiding twist direction of the first hoisting rope, so that a tightening effect is propagated from the straight portion throughout the first hoisting rope;

reattaching the first end of the first hoisting rope to the attachment; and repeating the releasing, providing, twisting, and reattaching for the remaining hoisting rope or ropes.

17. The method of claim 3, wherein re-tightening the two or more hoisting ropes comprises:

releasing a first end of the first hoisting rope from an attachment;

providing a straight portion of the first hoisting rope starting from the first end;

twisting the first hoisting rope from the first end in the braiding twist direction of the first hoisting rope, so that a re-tightening effect is propagated from the straight portion throughout the first hoisting rope;

reattaching the first end of the first hoisting rope to the attachment; and repeating the releasing, providing, twisting, and reattaching for the remaining hoisting rope or ropes.

18. The method of claim 1, wherein the method results in an elevator comprising two or more hoisting ropes that are tightened.

19. The method of claim 3, wherein the method results in an elevator comprising two or more hoisting ropes that are tightened.

* * * * *